United States Patent [19]

Kidd

[11] 4,181,158

[45] Jan. 1, 1980

[54] PORTABLE TABLE LOOM

[75] Inventor: Robert L. Kidd, Birmingham, Mich.

[73] Assignee: Ray Frost Fleming, Birmingham, Mich.

[21] Appl. No.: 890,471

[22] Filed: Mar. 27, 1978

[51] Int. Cl.[2] ..... D03D 29/00

[52] U.S. Cl. ..... 139/33

[58] Field of Search ..... 139/29–34; 128/151, 152

[56] References Cited

U.S. PATENT DOCUMENTS

| | | | |
|---|---|---|---|
| 2,253,329 | 8/1941 | Gallinger | 139/33 |
| 3,867,965 | 2/1975 | Hanson | 139/33 |
| 4,046,171 | 9/1977 | Wilson | 139/29 |

FOREIGN PATENT DOCUMENTS

| | | | |
|---|---|---|---|
| 846033 | 5/1939 | France | 139/33 |
| 23248 | of 1909 | United Kingdom | 139/33 |

*Primary Examiner*—James Kee Chi

*Attorney, Agent, or Firm*—Harness, Dickey & Pierce

[57] ABSTRACT

A portable table loom of compact and firm construction in which a simplified harness system is provided which includes transverse harness bars mounted in the system in pre-selected positions with the assurance that they will remain in such positions during the weaving process as well as when repeatedly moving the loom during an extended weaving time.

4 Claims, 5 Drawing Figures

PORTABLE TABLE LOOM

BACKGROUND OF THE INVENTION

Portable table looms have been known in the past but such looms have been of an unstable construction. In the use of such looms they are intended to be moved when not in use; during the time that the particular project is in progress. The harness system has not been of such stable construction as to assure the user of reliable continuity. This has been also true of the means employed to attempt an even warp tension.

SUMMARY OF THE INVENTION

According to the present invention a ruggedly constructed portable table loom is provided which is stable with a dependable harness system even though the loom may be repeatedly moved over a considerable period of time that the weaver is working on a particular project.

The loom includes a rigid rectangular frame, one crossmember forming the top reed member and the opposite crossmember forming the bottom reed member. Upstanding support members, of substantial width, are rigidly connected to the sides of the rectangular frame. The bottom of the support members are angled so that they support the loom with the bottom of the frame at the desired and proper working angle.

The facing surfaces of the top projections of the support members form a part of the harness system. They are each formed with a plurality of upwardly opening channel grooves, alternate grooves being of different lengths to provide sets of uniform lengths. Transverse harness dowels are disposed in such channel grooves of such lengths that the ends substantially abut the bottoms of the channels, and thus provide assurance against accidental displacement.

There are four of such harness dowels in the embodiment illustrated which are selectively disposed in the four deep channels or in the shallow top channels according to the design desired by the weaver.

Simplified and improved warping rod and warp tension means are also incorporated in the loom of the present invention.

BRIEF DESCRIPTION OF DRAWINGS

FIG. 5 is a partial schematic view of the loom illustrating a manner of threading the warp.

DESCRIPTION OF THE PREFERRED EMBODIMENT OF THE INVENTION

Figure 1:
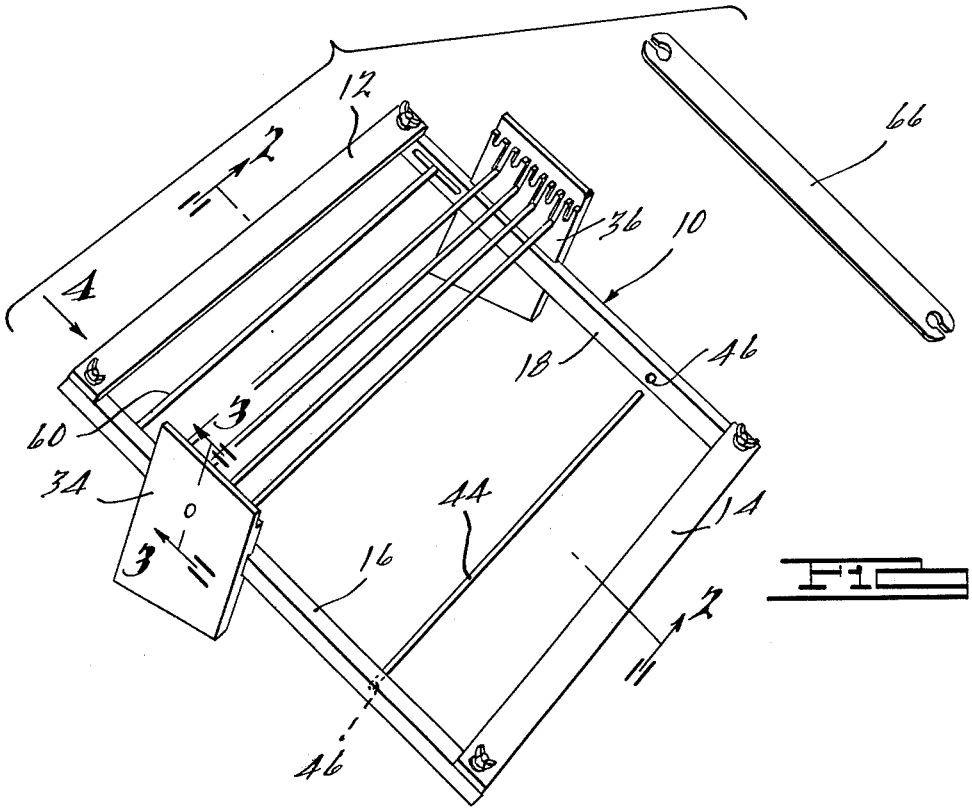
FIG. 1 is a separated perspective view of the loom of the present invention.

Referring to the drawings the loom is shown in FIG. 1 in perspective and comprises a rectangular frame generally indicated at 10. Such frame is formed with a top reed member 12, a bottom reed member 14, and side members 16 and 18.

Figure 4:
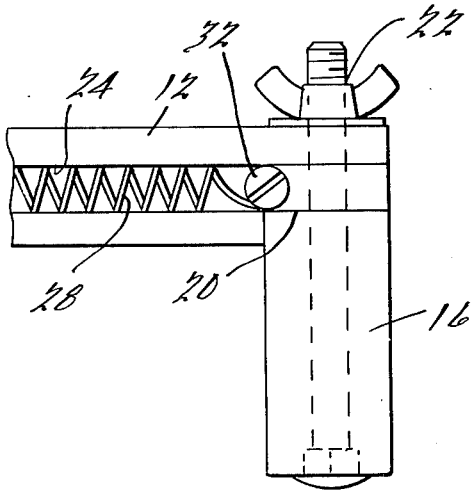
FIG. 4 is an enlarged partial end elevational view taken in the direction of the arrow 4 of FIG. 1.

The ends of the reed members 12 and 14 are rigidly connected to the ends of the side members 16 and 18, as illustrated in FIG. 4 for one of the corners. The ends of the members 12 and 14 are grooved as indicated at 20 so that the groove 20 is superimposed the adjacent end of the member 16 or 18 and secured thereto by a wing nut and bolt assembly 22. The bolt is received through aligned opeings in the members 16 and 18 and secured by the wing nut as illustrated in FIG. 4.

The outwardly facing ends of the reed members 12 and 14 are formed with longitudinally extending grooves 24 and 26, respectively, each of which is adapted to receive therein extended springs 28 and 30, respectively, which are secured at their ends by screws 32. The springs form spaces termed "dents" within which the warp threads are received and held in proper spaced selection in a manner known in the art.

Figure 3:
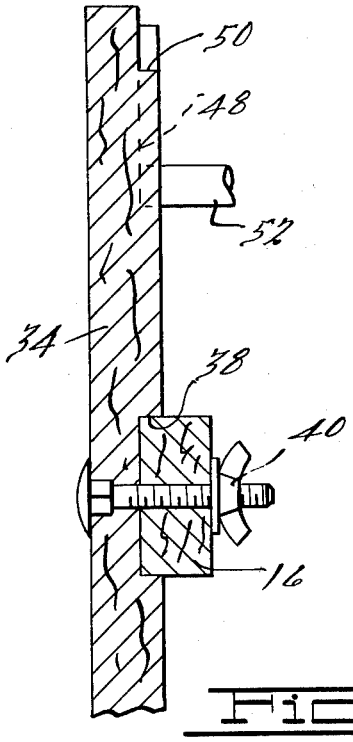
FIG. 3 is an enlarged partial cross-sectional view taken substantially along the line 3—3 of FIG. 1.

The frame 10 is supported by upstanding support members 34 and 36 which are disposed intermediate the ends of the frame members 16 and 18, respectively. The members 34 and 36 are each formed with transversely extending slots 38 and the members 16 and 18 are securely received within such slots (as illustrated in FIG. 3) and removably secured thereto by a wing nut and bolt assembly 40, the bolts being received through aligned openings in the members 16 and 36. The bottom ends of supports 34 and 36 are tapered as indicated at 42 so that the loom frame 10 is supported by the members 34 and 36 and the bottom of the frame 10 at the proper working angle on the support surface, as best shown in FIG. 2.

Figure 2:
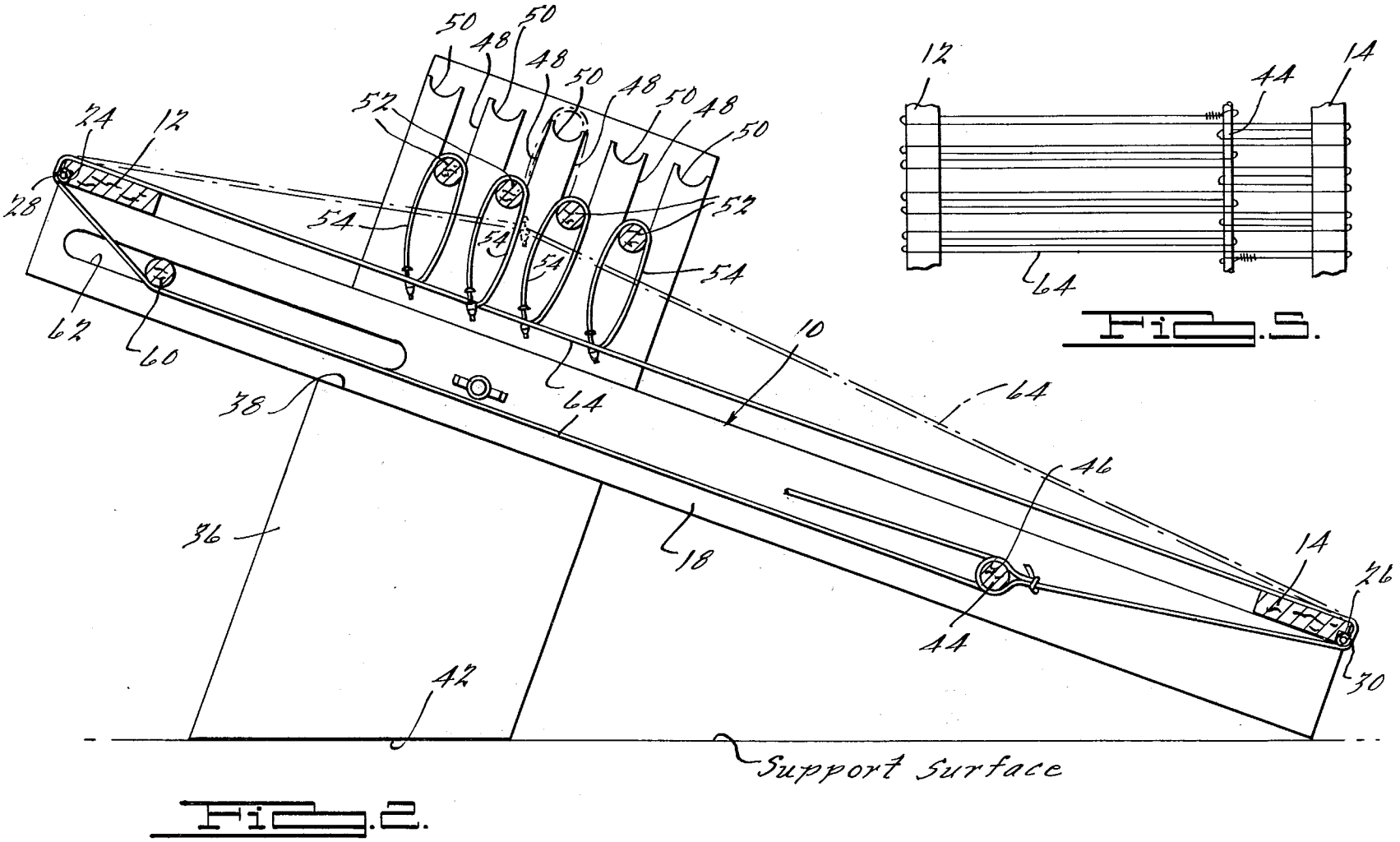
FIG. 2 is an enlarged cross-sectional view taken substantially along the line 2—2 of FIG. 1.

A warping bar or dowel 44 is positioned transversely of the frame 10 between said members 16 and 18 toward the lower end thereof as shown in FIGS. 1 and 2. Side members 16 and 18 are provided with oppositely disposed inwardly facing openings 46 which removably and selectively receive one end of the warping bar 44 and support the bar transversely. The bar 44 is of such length as to terminate short of the opposite side member. The bar 44 is positioned in one of the openings 46 when the warping thread is tied thereon, depending on whether the weaver is right or left handed.

The upper ends of the support 34 and 36 form a part of the harness system each of the upper ends is formed with a plurality of upward openings, channel grooves 48, there being four of such grooves in the embodiment illustrated. Upwardly opening alternate grooves 50 are also formed in the end faces of the intermediate portions of the harness, these being five in the embodiment illustrated.

The bottoms of the grooves 48 and 50 provide circular seats for the reception of transversely extending harness dowels 52, there being four of such harness dowels in the embodiment illustrated and as shown in FIG. 2. The four dowels are illustrated as received within the bottom of channel grooves 48. The dowels are dimensioned so that they are snugly received within the grooves 48 and are of such length as to closely abut the bottoms of the channel grooves 48 and the end face of the supports when disposed in the grooves 50 within the confines of the side walls of the grooves.

The harness bars are connected to the warp threads by means of loop heddles 54 as known in the art.

In order to properly tension the warp threads during weaving, a tension bar or dowel 60 is provided which extends transversely of the frame 10 with its ends received within facing channel grooves 62 formed in the members 16 and 18. The dowel 60 is dimensioned so that it fits snugly within the groove 62 with its ends abutting against the bottoms of the channel 62 and within the confines of the side walls of the grooves. When in operating position the bar 60 will be snugly in place but may be removed by tilting it crosswise and withdrawing it from between the warp threads 64; reversing this positioning to within the warp threads in engagement with the bottom threads.

In the use of the loom the warp bar 44 is pushed into the designated opening 46 in tight contact with the opposite end spaced from the side bar 18 as illustrated in FIG. 1. Harness dowels 52 and tension bar 60 are removed.

The frame loom is then warped by locating the center of the reed i.e. the center of the springs 28 and 30. Estimate one half (½) of the width of the fabric to be woven and begin winding from the left of center of loom. For example, if the product or sampler is to be six inches wide, locate the center of the loom and start winding three inches to the left of center. The springs 28 and 30 are constructed so that there are six dents or six threads per inch. There will therefore be a total of 36 threads, in this example.

Tie one end of the yarn or thread around the warping rod making a secure knot. Begin winding yarn under spring 30 moving to the front and over the top to the reed, making certain that the threads will be vertically straight. Wind over the back until reaching the warping rod and wrap yarn around the warping rod from the inside so that the yarn now is heading in the same direction toward the top. Place yarn in the next dent and continue to wind around the front, through the next dent, until you reach the rod again, then reverse the order and continue. This procedure is well understood in the art and is diagramatically illustrated in FIG. 5.

The design or pattern is established by pre-selecting the connection between the heddles 54 and their corresponding harness bars 52 and also pre-selecting the position of the harness bars 52 in the grooves 48 or 50.

The tension bar 60 may then be positioned to extend transversely of the frame 10 and engage the top of the lower warp threads, as shown in FIG. 2. Tension is adjusted by sliding the bar 60 within the grooves 62.

A shuttle 66 of conventional construction and use is shown in FIG. 1 and is used to weave the weft horizontally across the warp as well understood within the art.

I claim:

1. A portable table loom comprising a rigid rectangular frame including a top reed member and a bottom reed member interconnected by side members, upstanding support members rigidly connected to said side members intermediate the ends of said side members with the upwardly projecting portions thereof forming opposed and facing parts of the harness system and with the downwardly projecting portion providing with the bottom end of the frame the loom support, the facing parts of the harness system being formed with a plurality of upwardly opening and inwardly facing U-shaped channel grooves adapted to receive harness rods, said harness rods adapted to support heddles positionable within said channel grooves for pre-selected pattern positioning therein, the ends of the harness rods terminating closely adjacent the bottoms of the U-shaped channel grooves, and a warping rod extending transversely of the frame between the bottom reed member and the support members, said warping rod being slightly shorter than the space between the side members and being removably received in either one of two opposed openings formed in the side members.

2. A loom according to claim 1 in which said channel grooves are alternatively of different lengths.

3. A loom according to claim 1 in which said channel grooves include a plurality of shallow top opening grooves and a plurality of longer bottom grooves intermediate each pair of top opening grooves, for preselected spacing of said harness rods relative to each other.

4. A loom according to claim 1 in which the side members having elongated, closed end, facing channel grooves formed therein adjacent the top reed member end, and a transverse tension bar with its ends received in said grooves and longitudinally movable therein.

* * * * *